United States Patent [19]

Okamoto

[11] 4,203,144

[45] May 13, 1980

[54] CORONA CHARGER FOR IMAGE TRANSFER

[75] Inventor: Toyoo Okamoto, Yokohama, Japan

[73] Assignee: Ricoh Company, Ltd., Japan

[21] Appl. No.: 906,829

[22] Filed: May 17, 1978

[30] Foreign Application Priority Data

May 20, 1977 [JP] Japan ..... 52-58348

[51] Int. Cl.[2] ..... H01T 19/04

[52] U.S. Cl. ..... 361/234; 361/230; 355/3 CH; 250/324

[58] Field of Search ..... 361/214, 225, 230, 234; 355/3 CH; 250/324, 325, 326

[56] References Cited

U.S. PATENT DOCUMENTS

| | | | |
|---|---|---|---|
| 3,160,746 | 12/1964 | Clark | 355/3 CH |
| 3,233,156 | 2/1966 | Jarvis et al. | 361/230 |
| 3,578,970 | 5/1971 | Michaud et al. | 361/225 |
| 3,922,548 | 11/1975 | Honda | 250/325 |
| 3,937,960 | 2/1976 | Matsumoto et al. | 361/230 |
| 3,967,119 | 6/1976 | Matsumoto | 250/324 |

OTHER PUBLICATIONS

*Xerox Disc. Journal*, vol. 2, No. 6, Nov./Dec. 1977, p. 65, "Corona Generator with Adjustable Shield".

*Primary Examiner*—J. D. Miller
*Assistant Examiner*—L. C. Schroeder
*Attorney, Agent, or Firm*—McGlew and Tuttle

[57] ABSTRACT

In a corona charger for image transfer for use with an electrophotographic copying machine, a corona wire is stretched outwardly curved at the central portion thereof and the curved portion of the corona wire is positioned closer to the central portion of a transfer sheet to which an image is to be transferred, or is positioned so as to apply corona charges first to the central portion of the transfer sheet.

11 Claims, 7 Drawing Figures

CORONA CHARGER FOR IMAGE TRANSFER

BACKGROUND AND FIELD OF THE INVENTION

The present invention relates to an improved corona charger for image transfer for use with an electrophotographic copying machine.

DESCRIPTION OF THE PRIOR ART

When a toner image on a photoconductor is transferred to a transfer sheet by use of a corona charger, poor image transfer such as uneven image transfer or insufficient image transfer, is apt to occur if the transfer sheet is not brought into close contact with a surface of the photoconductor in a uniform manner. This occurs because, when the transfer sheet is brought into close contact with the surface of the photoconductor by an image transfer corona charger, air enters between the transfer sheet and the surface of the photoconductor and is trapped between them. The close contact of the transfer sheet to the surface of the photoconductor is therefore not attained so that a poor image transfer occurs. Such a phenomenon occurs frequently, particularly in wet type copying machines utilizing liquid developers.

Conventionally, such poor image transfer is prevented by use of a sheet transport guide plate whose tip is incurved as described in U.S. Pat. No. 3,820,889. This guide plate guides transfer sheets in such a manner that the central portion of the leading edge of each transfer sheet is first brought into contact with the surface of the photoconductor so that air between the surface of the photoconductor and the transfer sheet is caused to escape to both sides of the transfer sheet, and both sides of the transfer sheet are then graudally brought into close contact with the surface of the photoconductor. This method, however, still has shortcomings in since the shape of the guide plate is complicated and that it is difficult to keep the guide plate at its correct position relative to the surface of the photoconductor.

SUMMARY OF THE INVENTION

It is therefore a primary object of the invention to provide an improved corona charger for image transfer capable of performing a perfect image transfer without forming an air gap between a transfer sheet and the surface of a photoconductor by arranging a corona wire so as to apply corona charges first to the central portion of a transfer sheet.

In one embodiment of the invention, a corona wire is arranged so that the central portion of the wire comes closer to the central portion of the transfer sheets, whereby stronger corona charges are applied to the central portion of the transfer sheet than to the opposite sides of the transfer sheet. By this arrangement of the corona wire, the central portion of the transfer sheet is brought into closer contact with the surface of the photoconductor than the other portions of the transfer sheet, and air between the transfer sheet and the surface of the photoconductor is caused to escape from the central portion of the transfer sheet to the opposite sides of the transfer sheet so that poor image transfer due to the presence of air between the transfer sheet and the surface of the photoconductor is prevented.

In another embodiment of the invention, the central portion of a corona wire is overhung or projects in the direction opposite to the sheet transport direction so that corona charges are applied to the central portion of the transfer sheet first when it is transported in the direction of the photoconductor. Since this corona charger is capable of applying corona charges to the central portion of the transfer sheet first, the central portion of the transfer sheet is first brought into close contact with the surface, followed by the opposite side portions thereof so that air between the transfer sheet and the surface of the photoconductor escapes from the central portion of the transfer sheet to the opposite side portions thereof so that poor image transfer by the presence of air between the transfer sheet and the surface of the photoconductor is prevented.

In a further embodiment of the invention, the corona wire is arranged so that the central portion of the wire comes closer to the central portion of the transfer sheet, and at the same time overhangs or projects in the direction opposite to the sheet transport direction. This embodiment makes air escape most effectively from between the transfer sheet and the surface of the photoconductor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

For a better understanding of the invention as well as other objects and further features thereof, reference is made to the following detailed description of the invention to be read in conjunction with the accompanying drawings, wherein.

DETAILED DESCRIPTION OF THE PREFERRED EMBODIMENTS

Figure 1:
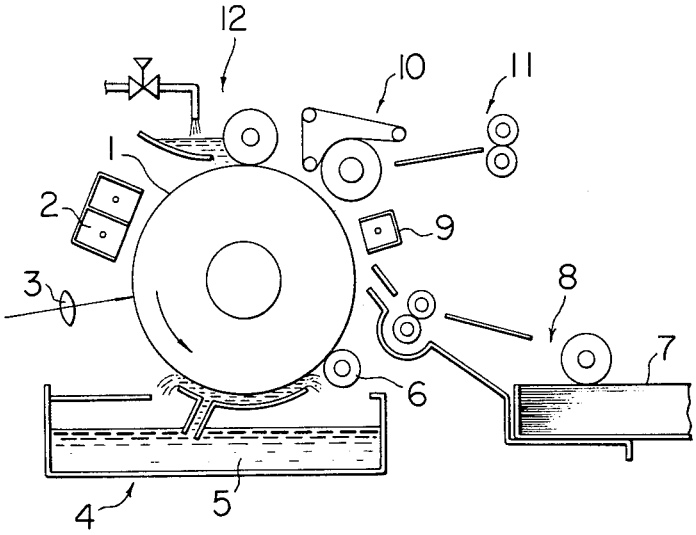
FIG. 1 is a schematic side elevational view of a wet type electrophotographic copying machine of the type used with a corona charger for image transfer according to the invention.

Referring now to the drawings, there is schematically shown in FIG. 1 a wet type electrophotographic copying machine of the type used with a corona charger for image transfer according to the invention. A photoconductor in the form of a photoconductive drum 1 having a photoconductive layer thereon is rotated counterclockwise at a predetermined speed. The surface of the photoconductive drum is first charged uniformly by a corona charger 2, and an image of an original is projected upon the surface of the photoconductive drum 1 by an exposure optical system 3, so that a latent electrostatic image is formed on the surface of the photoconductive drum 1. The latent electrostatic image is developed by a developer means such as by a liquid developer 5 contained in a development apparatus 4. The liquid developer which is thus deposited on the surface of the photoconductive drum 1 is squeezed by a squeeze roller 6, and a transfer sheet 7 is transported onto the photoconductive drum 1 by a sheet feed apparatus 8, and is then superimposed over and on a visual image which was formed on the surface of the photoconductor. A corona charge is applied to back side of the transfer sheet which is superimposed on the surface of the photoconductive drum 1. This corona charge is stronger than a charge capable of holding toner on the latent image and is formed by a corona charger 9. The image transfer thus takes place so that the visible toner image is transferred to the transfer sheet. The toner image bearing transfer sheet is separated from the surface of the photoconductive drum 1 by a sheet separation apparatus 10 and is then transported to an image fixing apparatus (not shown) by a sheet discharge apparatus 11. When the transfer sheet has been separated from the surface of the photoconductive drum 1, the surface is cleaned by a cleaning apparatus 12. One copying cycle is thus completed.

Figure 2:
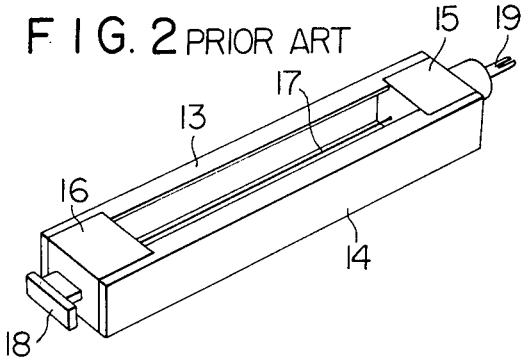
FIG. 2 PRIOR ART
FIG. 2 is a perspective view of a conventional corona charger for image transfer.

Usually, a prior art corona charger is designed as illustrated in FIG. 2, in which a pair of long and narrow metal shield plates 13, 14 are disposed so as to face each other and both ends of these metal shield plates 13, 14 are supported by a pair of insulating blocks 15, 16. Between both insulating blocks 15, 16 there is stretched straight a corona wire 17 parallel to the shield plates 13, 14. At an end portion of one insulating block 16, there is provided a knob 18, and at an end portion of the other insulating block 15, there is provided a connector 19 which is connected to the corona wire 17. At a predetermined position of the copying machine, there is disposed a guide plate for setting the position of the corona charger. By inserting the corona charger in the guide plate, the position of the corona charger relative to the surface of the photoconductive drum 1 is determined. At the same time, the connector 19 is connected to a high voltage power source.

Figure 3:
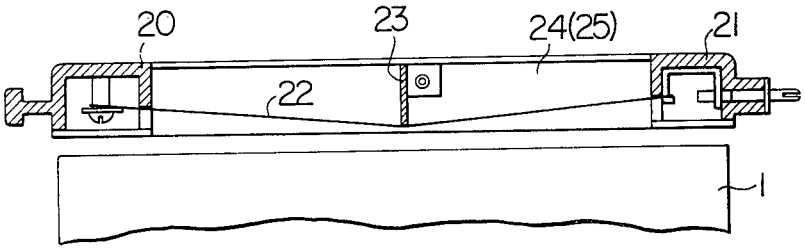
FIG. 3 is a schematic side elevational view of an embodiment of a corona charger according to the invention.
Figure 4:
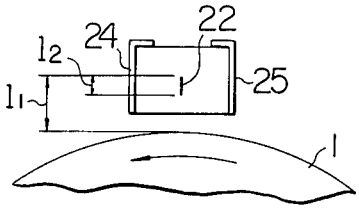
FIG. 4 is a schematic sectional side elevation of the corona charger of FIG. 3.

Referring to FIG. 3, there is shown a corona charger according to the invention. Between insulating blocks 20, 21, there is stretched a corona wire 22 parallel to shield plates 24, 25, with the central portion of the corona wire 22 supported by a support member 23 such that the central portion of the wire 22 comes closer to the surface of the photoconductive drum 1 than the other portions of the wire 22. FIG. 4 is a schematic side elevation of the corona charger of FIG. 3.

As an embodiment of the invention, the distance $l_1$ between the corona wire 22 at both ends thereof and the surface of the photoconductive drum 1 can be set at approximately 10 mm, and the height difference $l_2$ of the corona wire 22 between both ends of the wire 22 and the central portion thereof can be set at approximately 2 mm.

Figure 5:
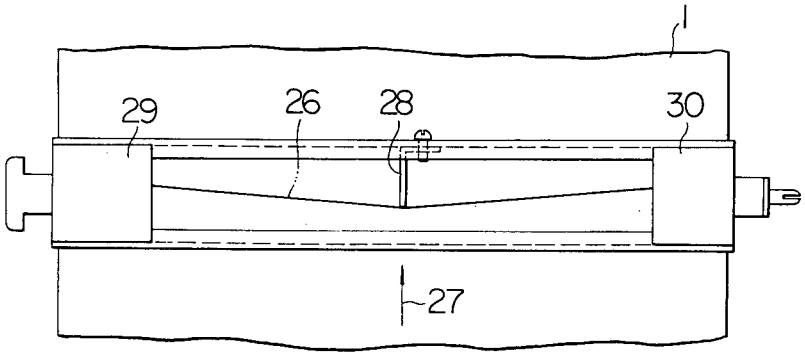
FIG. 5 is a schematic plan view of another embodiment of a corona charger according to the invention.
Figure 6:
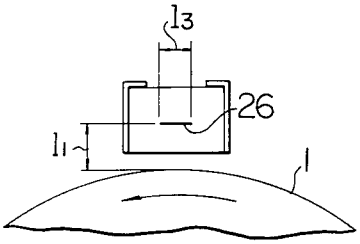
FIG. 6 is a schematic sectional side elevational view of the corona charger of FIG. 5.

Referring now to FIG. 5, there is shown another embodiment of the invention. Unlike FIG. 3, FIG. 5 is a schematic plan view of the embodiment. A corona wire 26 is stretched horizontally between insulating blocks 29, 30 so as to hang over the surface of the photoconductive drum 1 at the central portion of the wire 26 in the direction opposite to the sheet transport direction indicated by the arrow, with the central portion of the wire 26 supported by an insulating support member 28. FIG. 6 is a schematic side elevation of the corona charger of FIG. 5. In this embodiment, the distance $l_1$ between the corona wire 26 and the surface of the photoconductive drum 1 can be set at approximately 10 mm, and the horizontal difference between both end portions of the wire 26 and the central portion thereof can be set at approximately 5 mm.

Figure 7:
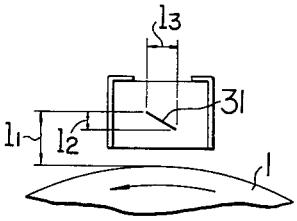
FIG. 7 is a schematic sectional side elevational view of a further embodiment of a corona charger according to the invention.

In a further embodiment of the invention, the corona wire stretching methods in the aforementioned two embodiments are combined. More specifically, a corona wire is stretched in such a manner that the central portion of the wire comes closer to the surface of the photoconductive member than the other portions of the wire and is directed in the direction opposite to a transfer sheet transport direction, with the central portion of the wire held by an insulating support plate. FIG. 7 is a schematic side elevation of this third embodiment of the invention. In this embodiment, for example, the distance $l_1$ between the end portions of the corona wire 31 and the surface of the photoconductive drum 1 can be set at approximately 10 mm, and the height difference $l_2$ between both end portions of the corona wire 31 and the central portion thereof at approximately 2 mm, and the horizontal difference $l_3$ between both end portions of the corona wire 31 and the central portion thereof at approximately 5 mm.

While specific embodiments of the invention have been shown and described in detail to illustrate the application of the principles of the invention, it will be understood that the invention may be embodied otherwise without departing from such principles.

What is claimed is:

1. A corona charger for transfering a visible toner image on a photoconductor to a transfer sheet comprising a corona wire stretched between a pair of insulating support members, said corona wire being curved outwardly at the central portion thereof and the curved portion of said corona wire being directed in the direction opposite to a transfer sheet transport direction so that a central portion of the transfer sheet is charged first by said central portion of the corona wire to adhere the transfer sheet to the photoconductor in its central portion before the adherence of the transfer sheet to the photoconductor in its remaining portions so that any air between the transfer sheet and the photoconductor is urged outwardly from between the transfer sheet and photoconductor.

2. A corona charger for transfering a visible toner image on a photoconductor to a transfer sheet comprising a corona wire stretched between a pair of insulating support members, said corona wire being curved outwardly at the central portion thereof and the curved portion of said corona wire being directed normal to a transfer sheet direction so that a central portion of the transfer sheet is charged first by said central portion of the corona wire to adhere the transfer sheet to the photoconductor in its central portion before the adherence of the transfer sheet to the photoconductor in its remaining portions so that any air between the transfer sheet and the photoconductor is urged outwardly from between the transfer sheet and photoconductor.

3. A corona charger for image transfer as claimed in claim 1, wherein said curved portion of said corona wire is directed parallel to said transfer sheet transport direction.

4. A corona charger for image transfer as claimed in claim 1, wherein said curved portion of said corona wire is inclined to said transfer sheet transport direction.

5. A corona charger for image transfer as claimed in claim 1, wherein said corona wire is supported by at least one insulating support member disposed between said pair of insulating support members.

6. A corona charger for image transfer as claimed in claim 2, wherein said corona wire is supported by at least one insulating support member disposed between said pair of insulating support members.

7. In a corona charger having a corona wire for transfering a visible toner image on a photoconductor from the photoconductor to a transfer sheet superimposed over the visible toner image on the photoconductor, the corona wire being spaced from the photoconductor and the photoconductor being movable with respect to the corona charger, an improvement comprising means for supporting a central portion of the corona wire in a position with respect to the remaining portion of the corona wire which is from a position with said central portion spaced closer to the photoconductor than said remaining portions of the corona wire to a position with said central portion projecting a direction opposite to the direction of motion of the photoconductor with respect to said remaining portion of the corona wire, whereby a central portion of the transfer sheet is charged first by said central portion of the corona wire to adhere the transfer sheet to the photoconductor in its central portion before the adherence of the transfer sheet to the photoconductor in its remaining portions so that any air between the transfer sheet and the photoconductor is urged outwardly from between the transfer sheet and the photoconductor.

8. An improvement according to claim 7 wherein said means for supporting said central portion of the corona wire supports the corona wire in a plane perpendicular to the visual toner image on the photoconductor.

9. An improvement according to claim 7 wherein said means for supporting said central portion of the corona wire supports the corona wire in a plane parallel to the visual toner image on the photoconductor.

10. Am improvement according to claim 7 wherein said means for supporting said central portion of the corona wire supports the corona wire in a plane extending at an angle to the visual toner image on the photoconductor.

11. An improvement according to claim 7 wherein the corona charger further includes a pair of facing shield plates extending in a direction perpendicular to the direction of motion of the photoconductor, a pair of insulating blocks connected at respective opposite ends of said shield plates, the corona wire extending between said insulating blocks, said means for supporting said central portion of the corona wire comprising an insulating support member extending at least one of either toward the photoconductor or toward a direction opposite to the direction of motion of the photoconductor.

* * * * *